US005887310A

United States Patent [19]

Wright

[11] Patent Number: 5,887,310

[45] Date of Patent: Mar. 30, 1999

[54] BACK SCRUBBING BRUSH WITH REMOVABLE COVER

[76] Inventor: Kevin Wright, 1 Hawley Ter. 3D, Yonkers, N.Y. 10701

[21] Appl. No.: 3,646

[22] Filed: Jan. 7, 1998

[51] Int. Cl.[6] ..... A47K 7/02

[52] U.S. Cl. ..... 15/209.1; 15/244.3; 15/247

[58] Field of Search ..... 15/208, 209.1, 15/210.1, 244.3, 247

[56] References Cited

U.S. PATENT DOCUMENTS

| | | | |
|---|---|---|---|
| 1,845,696 | 2/1932 | Auerbacher | 15/247 |
| 1,845,780 | 2/1932 | Auerbacher | 15/247 |
| 2,221,305 | 11/1940 | Chase | 15/247 |
| 2,580,226 | 12/1951 | Hempel | 15/210.1 |
| 2,602,947 | 7/1952 | Soss | 15/247 X |
| 2,726,418 | 12/1955 | Hempel | 401/201 |
| 5,177,831 | 1/1993 | Wirth | 15/247 X |

*Primary Examiner*—Mark Spisich

[57] ABSTRACT

A back scrubbing brush with removable cover including a new and improved planar scrubbing member that has a head portion with an interconnected handle portion. A head covering is formed of a pair of generally rectangular foam members encased in a plastic sheath. The head covering is positioned about the head portion. A generally rectangular jacket with a hollow is provided. The jacket has a peripheral edge therearound. The peripheral edge forms an upper edge, a lower edge and a pair of side edges therebetween. The upper edge has a zipper coupled thereto. The lower edge has a generally rectangular opening. The zipper and the rectangular opening allow the jacket to receive the planar scrubbing member.

6 Claims, 3 Drawing Sheets

BACK SCRUBBING BRUSH WITH REMOVABLE COVER

BACKGROUND OF THE INVENTION

1. Field of the Invention

The present invention relates to a back scrubbing brush with removable cover and more particularly pertains to providing a backwasher for gentle cleansing of the skin and further providing a interchangeable covering.

2. Description of the Prior Art

The use of a back scrubber is known in the prior art. More specifically, back scrubbers heretofore devised and utilized for the purpose of body cleansing are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,323,506 to Babitch discloses a cleaning implement for use on building surfaces. U.S. Pat. No. 5,044,806 to Nickelston discloses a back scrubber. U.S. Pat. No. Des. 312,709 to Lindsay and Lindsay discloses a back scrubber. U.S. Pat. No. 4,475,836 to Colognori discloses a back scrubber and/or backscratcher with removable sponge element. U.S. Pat. No. Des. 267,671 to Kupchik discloses a back scrubber. Lastly, U.S. Pat. No. Des. 258,151 to Nakagawa discloses a back scrubber.

In this respect, the back scrubbing brush with removable cover according to the present invention substantially departs from the conventional concepts and designs of the prior art, and in so doing provides an apparatus primarily developed for the purpose of providing a backwasher for gentle cleansing of the skin and further providing a interchangeable covering.

Therefore, it can be appreciated that there exists a continuing need for a new and improved back scrubbing brush with removable cover which can be used for providing a backwasher for gentle cleansing of the skin and further providing a interchangeable covering. In this regard, the present invention substantially fulfills this need.

SUMMARY OF THE INVENTION

In view of the foregoing disadvantages inherent in the known types of back scrubber now present in the prior art, the present invention provides an improved back scrubbing brush with removable cover. As such, the general purpose of the present invention, which will be described subsequently in greater detail, is to provide a new and improved back scrubbing brush with removable cover which has all the advantages of the prior art and none of the disadvantages.

To attain this, the present invention essentially comprises a planar scrubbing member. The planar scrubbing member has a head portion with an interconnected handle portion. The planar scrubbing member has a top surface, a bottom surface and a peripheral end edge therearound. The handle portion extends from the head portion. Included is a head covering. The head covering is formed of a pair of generally rectangular foam members encased in a plastic sheath. The plastic sheath is compartmentalized with a fold for separation. Each one of the pair of foam members is enclosed within one of the compartments of the plastic sheath. The head covering is positioned about the head portion and supported thereon with the fold.

Lastly, a generally rectangular jacket with a hollow is provided. The jacket has a first surface, a second surface and a peripheral edge therearound. The peripheral edge forms an upper edge, a lower edge and a pair of side edges therebetween. The upper edge has a zipper coupled thereto and extends from one of the side edges to another of the side edges. The zipper defines an entrance into the hollow of the jacket. The lower edge has a generally rectangular opening. The zipper, when in an open orientation, allows the head portion of planar scrubbing member, with the head covering, to be positioned therein. The handle extends from rectangular opening when the head portion is positioned within the jacket. The zipper is in a closed orientation for encapsulating the head portion, with the head covering, and allowing a user to wet the jacket for rubbing of the first surface and second surface against the skin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved back scrubbing brush with removable cover which has all the advantages of the prior art back scrubbers and none of the disadvantages.

It is another object of the present invention to provide a new and improved back scrubbing brush with removable cover which may be easily and efficiently manufactured and marketed.

It is a further object of the present invention to provide a new and improved back scrubbing brush with removable cover which is of a durable and reliable construction.

An even further object of the present invention is to provide a new and improved back scrubbing brush with removable cover which is susceptible of a low cost of manufacture with regard to both materials and labor, and which accordingly is then susceptible of low prices of sale to the consuming public, thereby making such back scrubbing brush with removable cover economically available to the buying public.

Still yet another object of the present invention is to provide a new and improved back scrubbing brush with removable cover which provides in the apparatuses and methods of the prior art some of the advantages thereof, while simultaneously overcoming some of the disadvantages normally associated therewith.

Still another object of the present invention is to providing a backwasher for gentle cleansing of the skin and further providing a interchangeable covering.

Lastly, it is an object of the present invention to provide a new and improved planar scrubbing member that has a head portion with an interconnected handle portion. A head covering is formed of a pair of generally rectangular foam members encased in a plastic sheath. The head covering is positioned about the head portion. A generally rectangular jacket with a hollow is provided. The jacket has a peripheral edge therearound. The peripheral edge forms an upper edge, a lower edge and a pair of side edges therebetween. The upper edge has a zipper coupled thereto. The lower edge has a generally rectangular opening. The zipper and the rectangular opening allow the jacket to receive the planar scrubbing member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
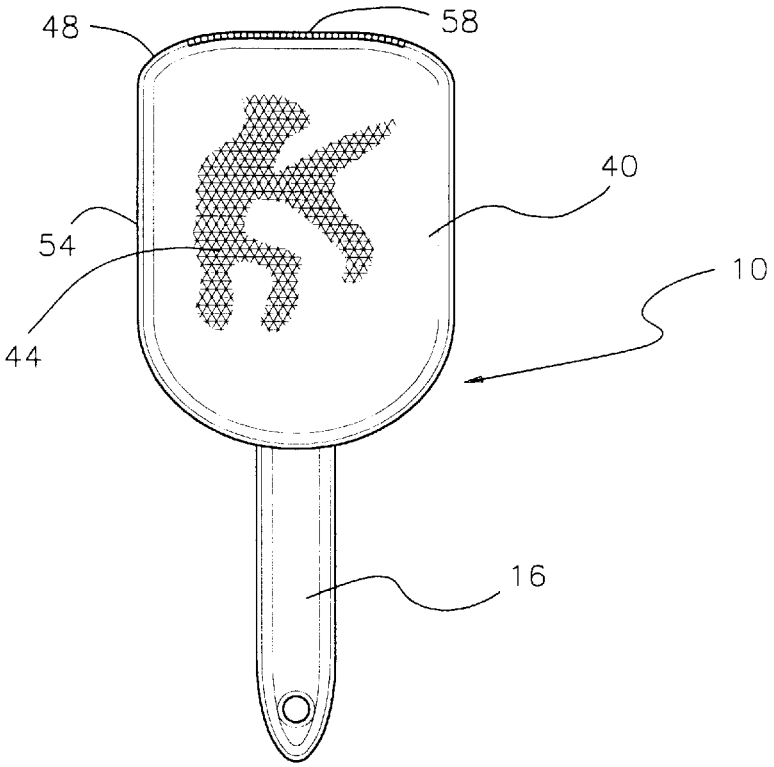
FIG. 1 is a perspective illustration of the preferred embodiment of the back scrubbing brush with removable cover constructed in accordance with the principles of the present invention.

With reference now to the drawings, and in particular to FIG. 1 thereof, a new and improved Back scrubbing brush with removable cover embodying the principles and concepts of the present invention and generally designated by the reference numeral 10 will be described.

The present invention, the new and improved Back scrubbing brush with removable cover, is comprised of a plurality of components. Such components in their broadest context include scrubbing member a jacket and a head covering. Such components are individually configured and correlated with respect to each other so as to attain the desired objective.

Figure 4:
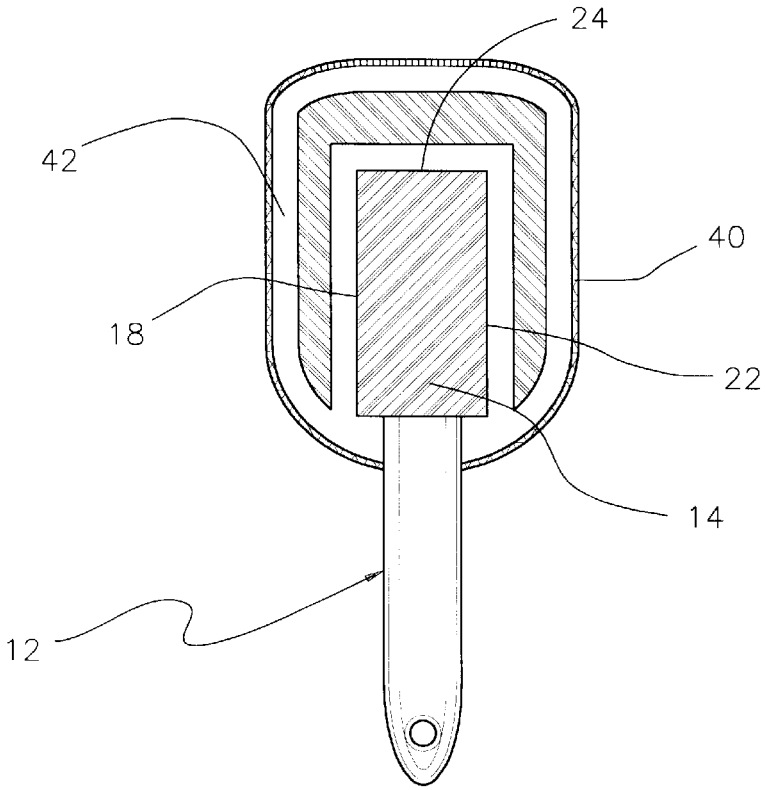
FIG. 4 is a cross-sectional view of the present invention taken along line 4—4 of FIG. 3.

More specifically, the present invention includes a planar scrubbing member 12. The scrubbing member is formed of plastic or wood. Preferably the scrubbing member is formed of plastic for durability and long life. The planar scrubbing member has a head portion 14 with an interconnected handle portion 16. The planar scrubbing member has a top surface 18, a bottom surface 22 and a peripheral end edge 24 therearound. The handle portion, as shown in FIG. 4, extends from the head portion.

Figure 2:
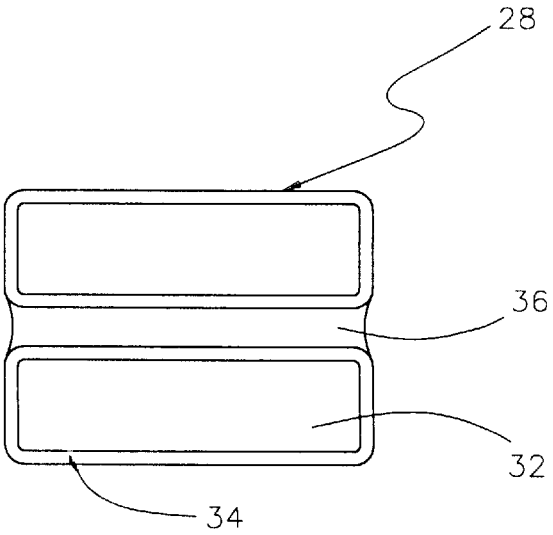
FIG. 2 is perspective illustration of the foam with the plastic sheath.

Included is a head covering 28. The head covering is formed of a pair of generally rectangular foam members 32 encased in a plastic sheath 34. As shown in FIG. 2, the plastic sheath is compartmentalized with a fold 36 for separation. Each one of the pair of foam members is enclosed within one of the compartments of the plastic sheath. The plastic sheath provides a water tight environment that keeps the foam member dry. The head covering is positioned about the head portion and supported thereon with the fold. The fold allows the head covering to hang freely over the head portion of the scrubbing member.

Figure 3:
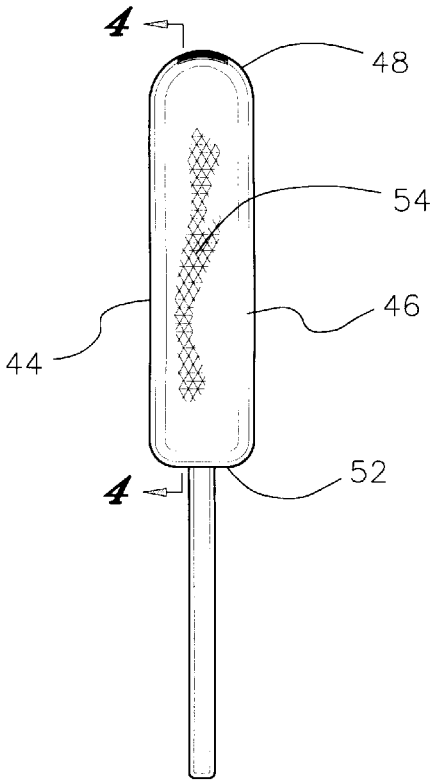
FIG. 3 is a right side view of the present invention.
Figure 5:
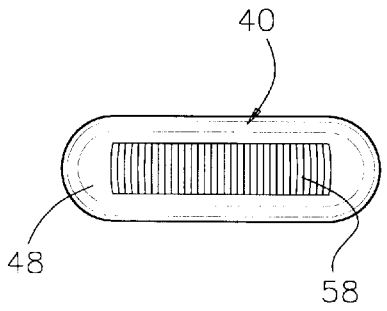
FIG. 5 is top plan view of the present invention.
Figure 6:
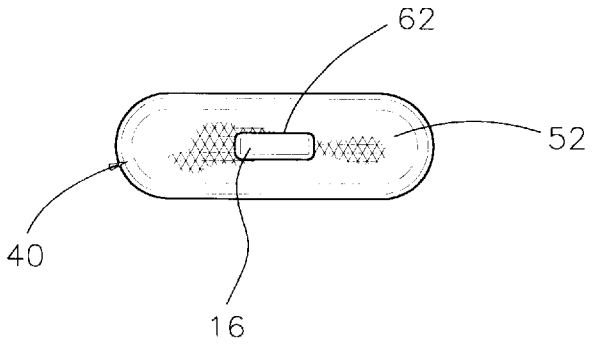
FIG. 6 is bottom plan view of the present invention.

Lastly, a generally rectangular jacket 40 with a hollow 42 is provided. The jacket of formed of a soft fabric, preferably terri cloth. As illustrated, the jacket has a first surface 44, a second surface 46 and a peripheral edge therearound. The peripheral edge, as seen in FIG. 3, forms an upper edge 48, a lower edge 52 and a pair of side edges 54 therebetween. The upper edge, as depicted in FIG. 5, has a zipper 58 coupled thereto and extends from one of the side edges to another of the side edges. The zipper is formed of plastic. The zipper defines an entrance into the hollow of the jacket, as seen in FIG. 4. The lower edge has a generally rectangular opening 62. The zipper, when in an open orientation, allows the head portion of planar scrubbing member, with the head covering, to be positioned therein. The handle extends from the rectangular opening when the head portion is positioned within the jacket. The zipper is in a closed orientation for encapsulating the head portion, with the head covering, and allowing a user to wet the jacket for rubbing of the first surface and second surface against the skin.

The present invention back scrubbing brush with removable cover is an easy to use bath tool. The invention is formed of a scrubbing member that has a pair of foam covers, with each fitting into a jacket. The jacket has a zipper and an opening. The zipper allows access to the hollow of the jacket. The opening allows the handle to exit the jacket.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved back scrubbing brush with removable cover comprising in combination:

a planar scrubbing member having a head portion with an interconnected handle portion, the planar scrubbing member having a top surface, a bottom surface and a peripheral end edge therearound, the handle portion extending from the head portion;

a head covering being formed of a pair of generally rectangular foam members encased in a plastic sheath, the plastic sheath being compartmentalized with a fold for separation, each one of the pair of foam members being enclosed within one of the compartments of the plastic sheath, the head covering being positioned about the head portion and supported thereon with the fold; and a generally rectangular jacket having a hollow and having a first surface, a second surface and a peripheral edge therearound, the peripheral edge forming an upper edge, a lower edge and a pair of side edges therebetween, the upper edge having a zipper coupled thereto and extending from one of the side edges to another of the side edges, the zipper defining an entrance into the hollow of the jacket, the lower edge having a generally rectangular opening, the zipper being in an open orientation for allowing the head portion of planar scrubbing member, with the head covering, to be positioned therein, the handle extending from rectangular opening when the head portion being positioned within the jacket, the zipper being in a closed orientation for encapsulating the head portion with the head covering for allowing a user to wet the jacket for rubbing of the first surface and second surface against the skin.

2. A back scrubbing brush with removable cover comprising:

a planar scrubbing member having a head portion with an interconnected handle portion;

a head covering being formed of a pair of generally rectangular foam members encased in a plastic sheath, the head covering being positioned about the head portion; and a generally rectangular jacket having a hollow and a peripheral edge therearound, the peripheral edge forming an upper edge, a lower edge and a pair of side edges therebetween, the upper edge having a zipper coupled thereto, the lower edge having a generally rectangular opening, the zipper and the rectangular opening allowing the jacket to receive the planar scrubbing member therein.

3. A back scrubbing brush with removable cover as set forth in claim 2, wherein the planar scrubbing member having a top surface, a bottom surface and a peripheral end edge therearound, and the handle portion extending from the head portion.

4. A back scrubbing brush with removable cover as set forth in claim 2, wherein the plastic sheath being compartmentalized with a fold for separation, each one of the pair of foam members being enclosed within one of the compartments of the plastic sheath.

5. A back scrubbing brush with removable cover as set forth in claim 2, wherein the jacket having a first surface and a second surface.

6. A back scrubbing brush with removable cover as set forth in claim 2, wherein the zipper extending from one of the side edges to another of the side edges, and the zipper defining an entrance into the hollow of the jacket.

* * * * *